US006386231B1

(12) United States Patent
Elser

(10) Patent No.: US 6,386,231 B1
(45) Date of Patent: May 14, 2002

(54) VALVE ASSEMBLY WHICH SIMULATES A HAND PUMP

(76) Inventor: James Elser, 601A Convent Rd., Aston, PA (US) 19014

( * ) Notice: Subject to any disclaimer, the term of this patent is extended or adjusted under 35 U.S.C. 154(b) by 0 days.

(21) Appl. No.: 09/602,724

(22) Filed: Jun. 26, 2000

Related U.S. Application Data

(60) Provisional application No. 60/142,001, filed on Jul. 1, 1999.

(51) Int. Cl.[7] ..... F16K 31/44

(52) U.S. Cl. ..... 137/565.12; 137/565.37; 137/801

(58) Field of Search ..... 417/411, 410.1; 137/801, 565.12, 565.37, 625.48

(56) References Cited

U.S. PATENT DOCUMENTS 4,413,778 A * 11/1983 Middlemiss ..... 239/17
5,367,805 A * 11/1994 Bates ..... 40/406
6,206,298 B1 * 3/2001 Ting ..... 239/20

* cited by examiner

*Primary Examiner*—Charles G. Freay
(74) *Attorney, Agent, or Firm*—Eugene E. Renz, Jr.

(57) ABSTRACT

Hand operated, functional pump systems to pump fresh water from a hose connection or permanent connection comprise novel flow control mechanisms wherein the principal embodiment utilizes a piston rod, piston head arrangement sliding within a cylindrical jacket to expose water intake ports to outlet manifold ports through the action of a pump handle thereby controlling the flow of water to an outlet spout. In another embodiment, tandem valves, in one model, are controlled by a novel linkage arrangement to open and close each valve in a predetermined manner to allow or stop the flow of water.

1 Claim, 11 Drawing Sheets

VALVE ASSEMBLY WHICH SIMULATES A HAND PUMP

FIELD OF THE INVENTION

This application claims the benefit of U.S. Provisional Application No. 60/142,001, filed Jul. 1, 1999.

BACKGROUND OF THE INVENTION

The present invention relates to generally to pump systems and specifically to an improvement on conventional pumps which are used to draw water from wells on farms or the like. These pumps typically included an elongated pipe which extended into the ground into the water supply at a piston in the pump actuatable by a pump handle to create a vacuum in the pipe line and thereby draw water from the well.

SUMMARY OF THE INVENTION

The present invention provides pump systems which are constructed to simulate fully functional, hand manipulated water pumps. A cylindrical housing internal to the pump's support structure and comprising inlet and outlet ports provides the conduit for water to enter and exit. A movable rod inserted into the cylindrical housing is provided with piston heads spaced in a predetermined manner and attached to a mechanical arm that is activated with a pump handle. Pumping the handle up and down causes the movable rod to slide within the cylindrical housing alternately exposing and closing off inlet and outlet ports. Water enters through the exposed inlet port and is pushed through the cylindrical housing by the sliding rod and piston heads and expelled through the spout via the outlet port. The expelled water is directed to a drain connection. Water or other fluids from a source are introduced by a removable hose connection or a permanent connection.

In accordance with another embodiment of the present invention, water is recirculating by an electrically activated pump. Recirculation is initiated by first filling a tripod bucket situated beneath the pump expulsion spout with water. When raised, the pump handle trips a switch supplying power to the electric pump. Recirculation of the water continues until power is removed from the electric pump. A drain function is provided to renew the water.

An accordance with still another embodiment of the present invention there is produced a unique combination of valves, linkages, and springs to allow or inhibit water flow. The system comprises a piping system wherein two valves are spaced in line in a pipe and linked in such a way that when one is open the other is closed. The linkages are connected to a control arm attached to a movable handle. Pumping the handle causes the valves to alternately open and close allowing water under pressure from its source to be expelled through a spout.

BRIEF DESCRIPTION OF THE DRAWINGS

These and other objects of the present invention and various features and details of the construction thereof are hereinafter more fully set forth with reference to the accompanying drawings, wherein.

DETAILED DESCRIPTION OF THE PREFERRED EMBODIMENTS

Figure 1:
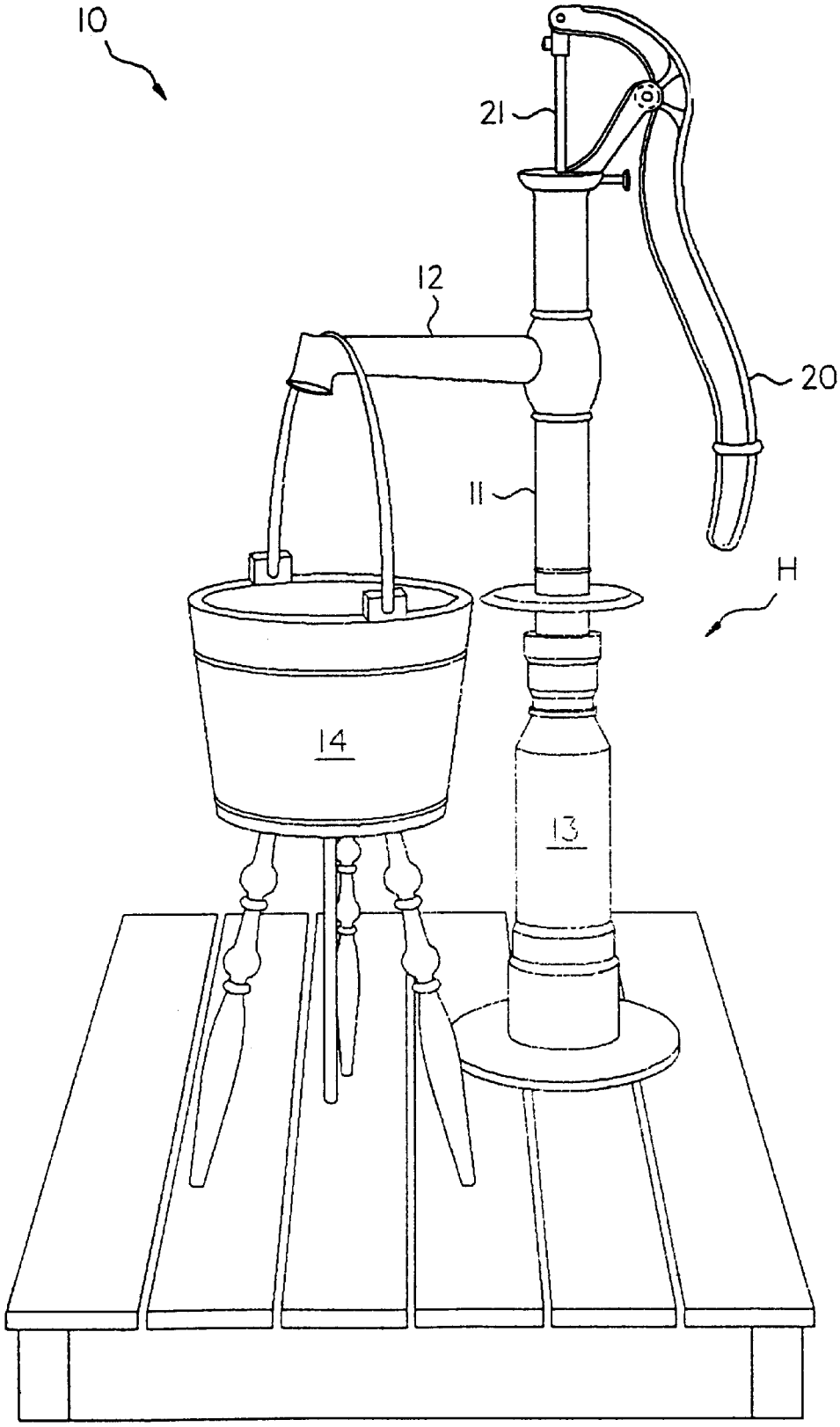
FIG. 1 is a recirculating-type pump system with tripod bucket.
Figure 2:
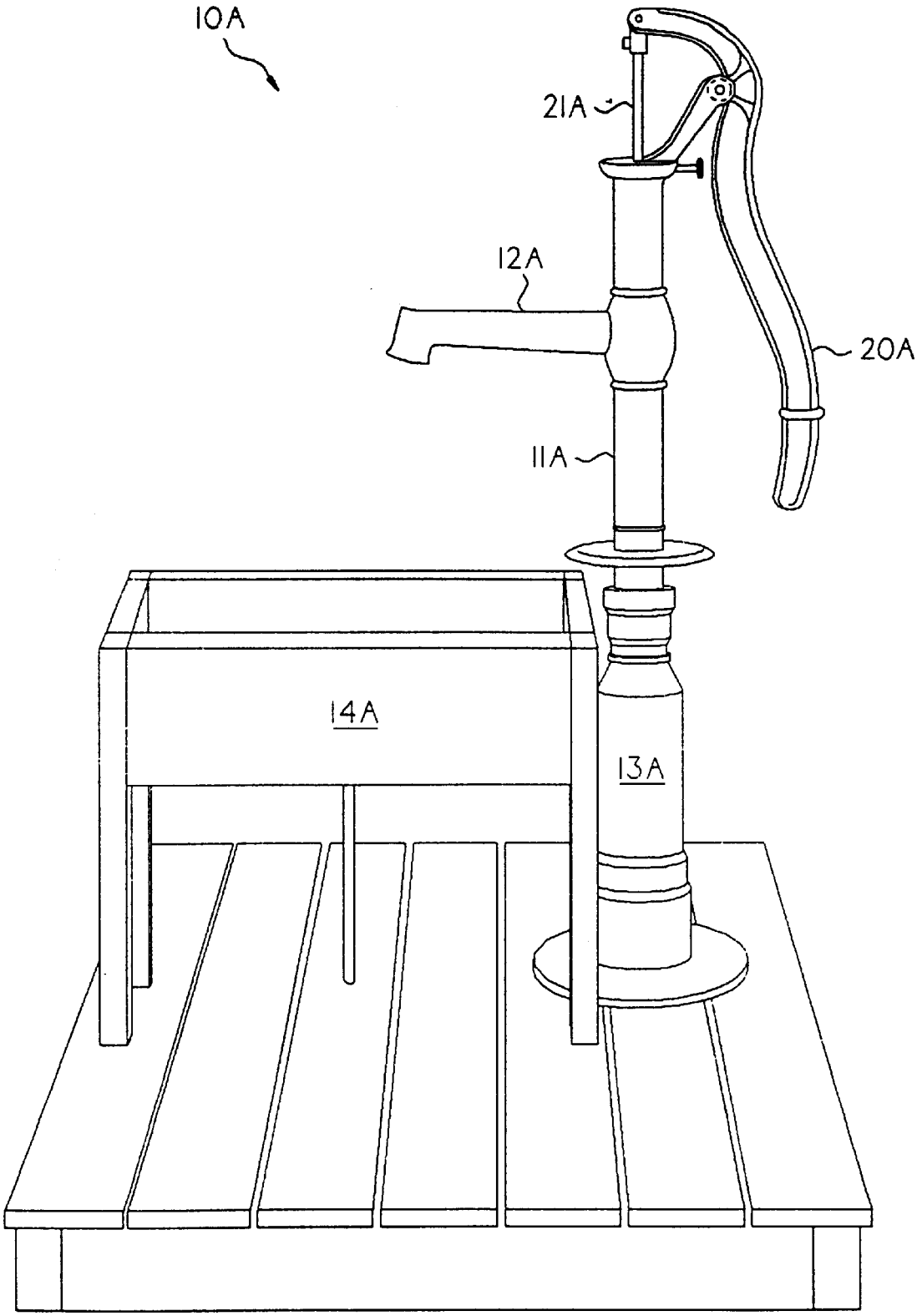
FIG. 2 shows a free standing outdoor-type pump system with basin.
Figure 3:
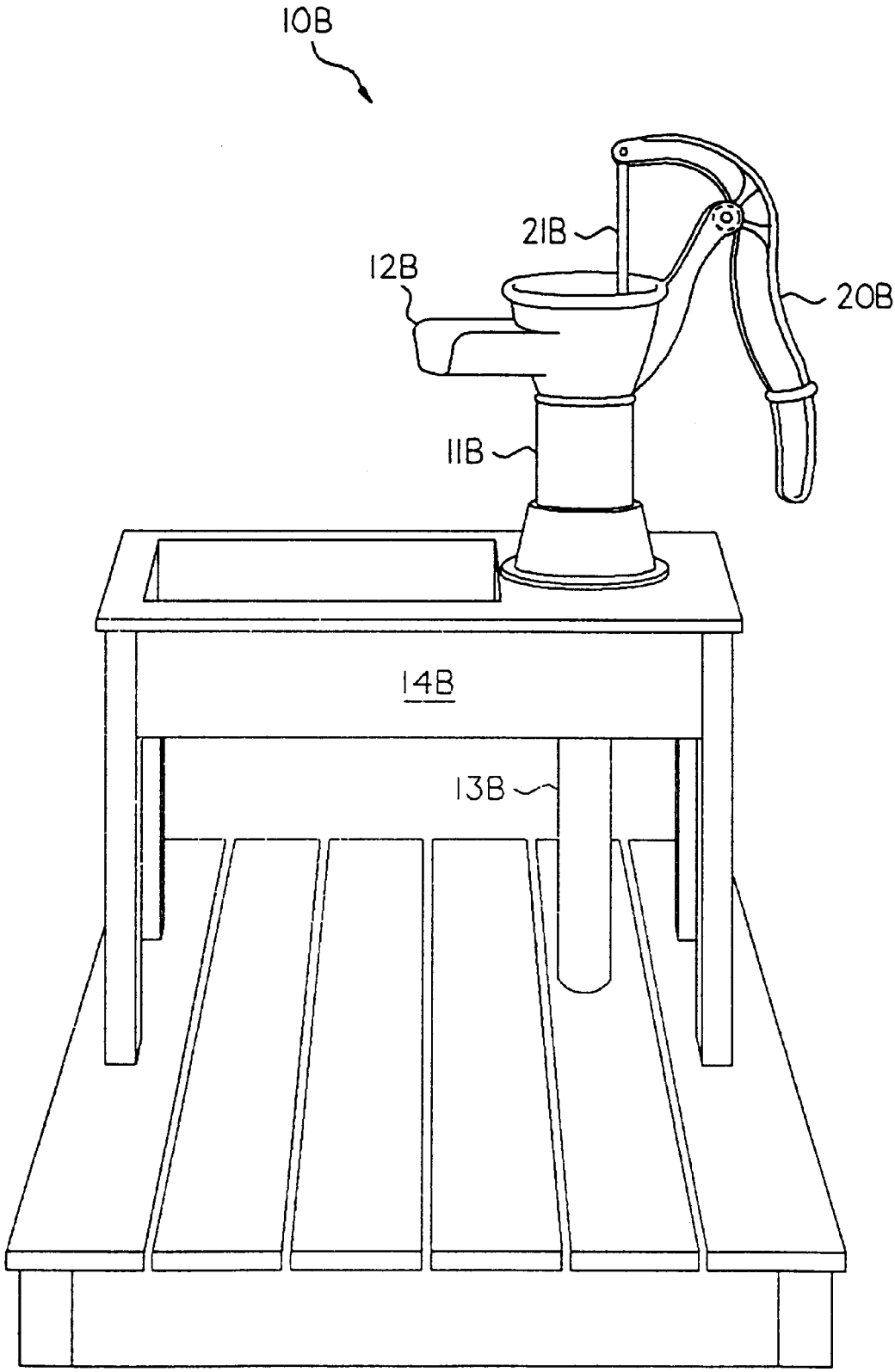
FIG. 3 is an in-house pitcher-type pump system on a dry sink.

Referring now to the drawings and particularly to FIGS. 1, 2, and 3 thereof, there is shown typical settings for a pump assembly embodying a water circulating system in accordance with the present invention. As illustrated in FIG. 1, the pump generally comprises an elongated hollow cylindrical housing (H), which in accordance with the embodiment illustrated in FIG. 1 has an upper chamber (11) and a lower chamber (13). A spout (12) extends from the upper chamber (11) and supports in the illustrated embodiment a tripod bucket (14). The pump assembly further includes a handle (20) pivotally connected to an elongated control rod (21).

The water pump system for this embodiment of the invention is of the recirculating type shown in FIG. 4 described in more detail herein below.

The configuration shown in FIG. 2 is generally similar to that described in FIG. 1 and accordingly like parts are designated with the same reference numerals with the subscript "a". However, in this instance, instead of the tripod bucket (14), the set up includes a generally rectangular four-legged receptacle **(14*a*)**.

FIG. 3 shows still another environment for a water pump system in accordance with the present invention, the details of which are shown in FIGS. 5–12, inclusive and will be described hereinafter. The pump components which are generally similar to those shown in FIGS. 1 and 2 are given the same reference numeral with the subscript "b".

Figure 4:
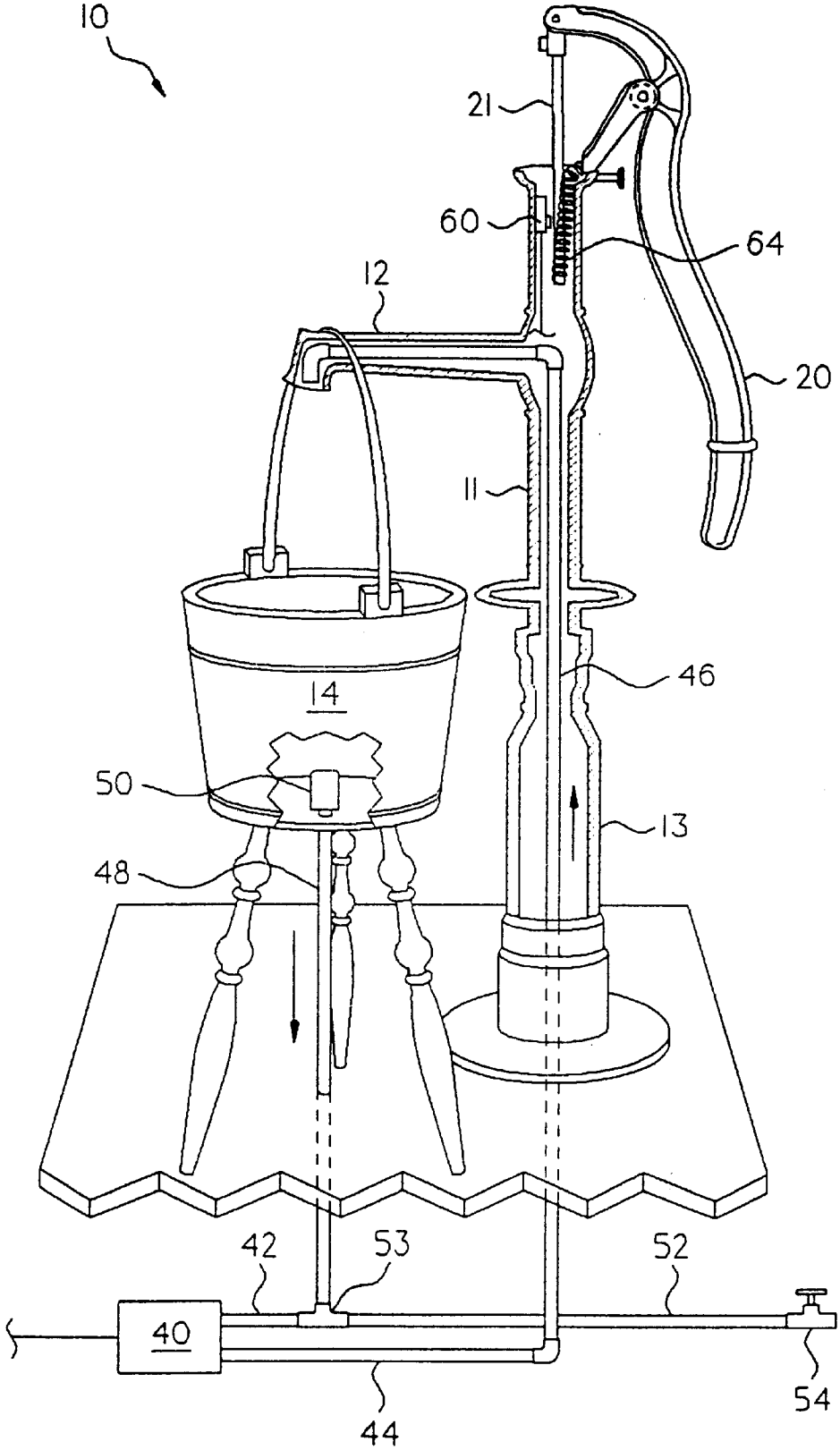
FIG. 4 is a perspective view partly in section of a recirculating pump system showing internal piping and fluid flow.
Figure 5:
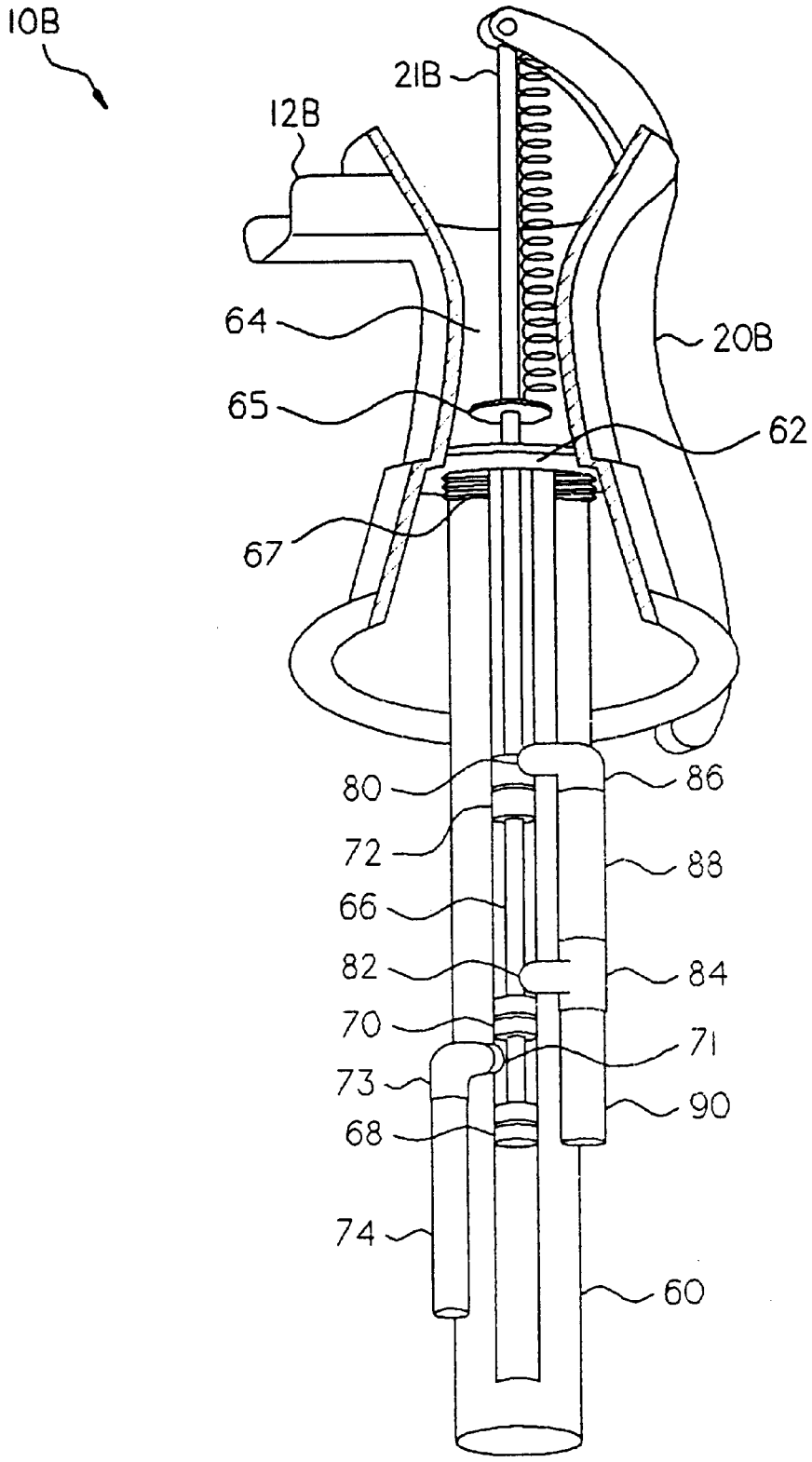
FIG. 5 is a perspective view partly in section showing a second embodiment of pump system in accordance with the present invention.

Considering first the recirculating pump system shown in FIG. 4, this system is designed to continuously recirculate a predetermined quantity of fluid upon activation of the pump handle (20). To this end, the recirculating fluid flow control system comprises a pump (40), an inlet pipe section (42) and a discharge pipe section (44) which as illustrated in FIG. 4 extends as at 46 extending upwardly through the pump housing (H) and terminates at the discharge end of the spout (12). The inlet pipe section (42) has a section (48) extending into the bucket (14) which mounts a filter (50). A T-connection (53) connects a drain line (52) with a control valve (54) for selectively draining the system when desired in the manner described in more detailed below. The operation of the pump is controlled by an electric switch (60) connected to an appropriate power source, (not shown), and operable between on and off positions by activation of the pump handle (20).

Considering now a typical cycle of operation, the bucket (14) is initially filled with a predetermined quantity of water and when it is desired to initiate recirculation, the pump handle (20) is raised which pivots the control rod (21) through a small arc to activate switch (60) and to supple power to electric pump (40) thereby drawing water from the bucket (14) through filter (50) back up through pipe (46) and out spout (12). The control rod (21) is normally biased to its rest position shown in FIG. 4 by a spring (S). When it is desired to stop circulation of water in the manner described above, the pump handle (20) is simply activated again to engage switch (60) and shut down electric pump (40) to stop circulation of water in the manner indicated. When it is desired to drain the water in the bucket, the valve (54) is simply opened permitting flow of water from the bucket (14) to a suitable drain through line (52).

The second embodiment of pump system in accordance with the present invention is shown in FIGS. 5–11, inclusive. Broadly speaking, the system incorporates a spool-type flow control valve mechanism operable between various positions to deliver water from a pressurized source to the spout (12*b*) in the manner described below. More specifically, the system includes an elongated hollow cylindrical housing (H) and connected to a wall (62) in the spout chamber (64) by a threaded connection as at 67. The assembly further includes an elongated valve shaft (60) mounting in the present instance three piston heads (68, 70 and 72) at axially spaced location along the rod (66). The housing (H) has an inlet port (71) connected by a fitting (73) and a line (74) to a suitable source of water under pressure. The housing also has two axially spaced flow control ports (80, 82) connected by a line (88). A drain line (90) is also connected to the fitting (84) for a purpose to be described below.

Figure 6:
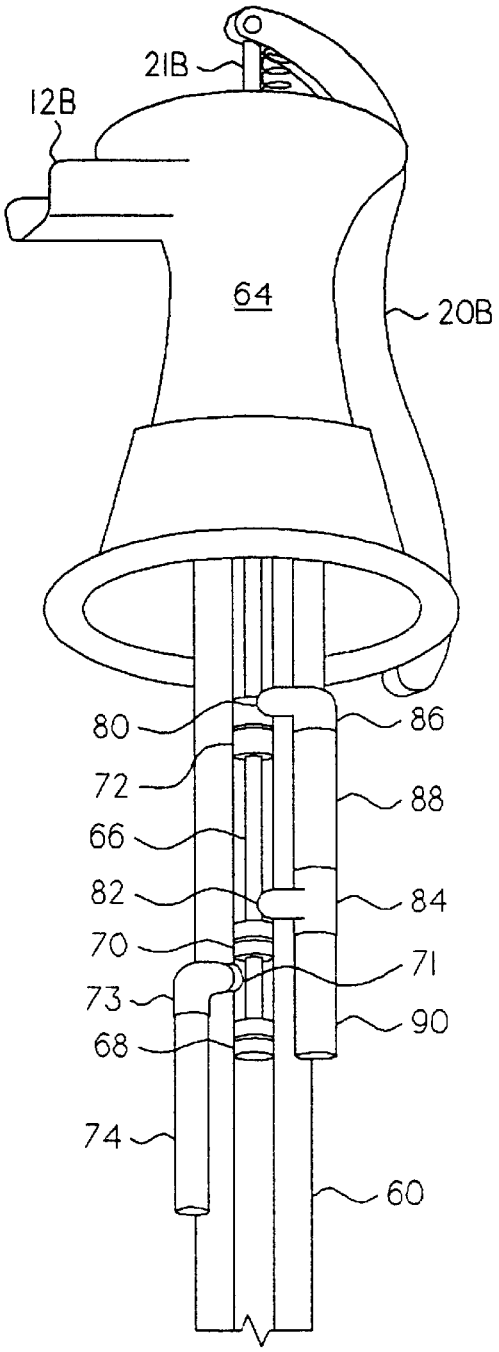
FIGS. 6, 7, 7A and 8 are perspective views showing various operating positions of the pump system for the second embodiment of the present invention.
Figure 7:
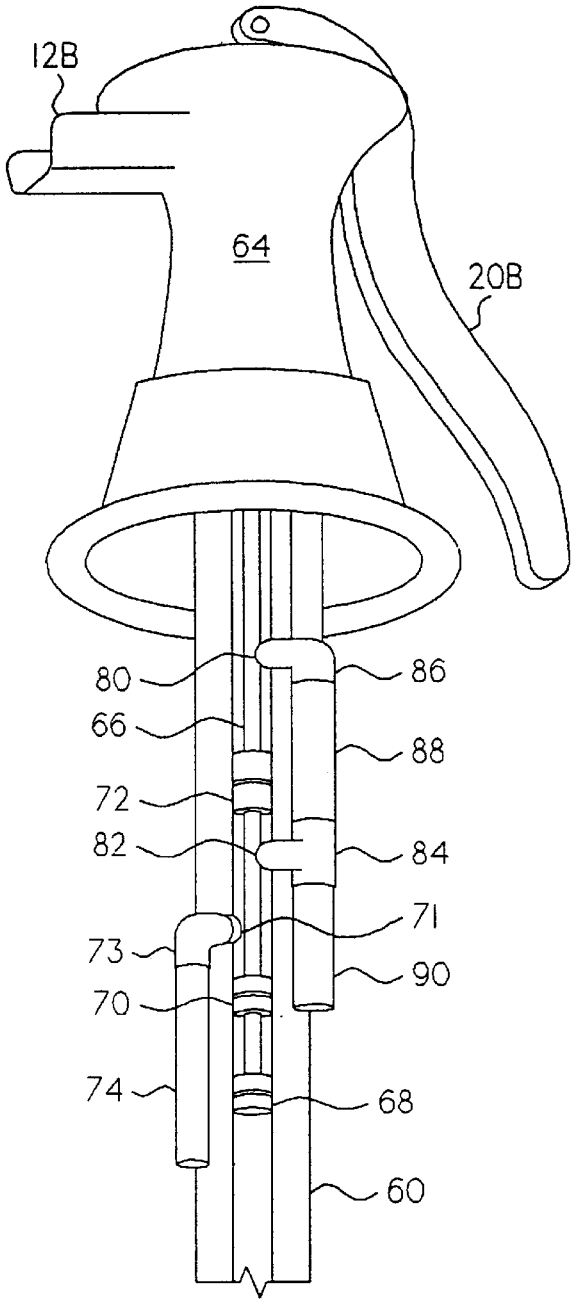
Figure 7A:
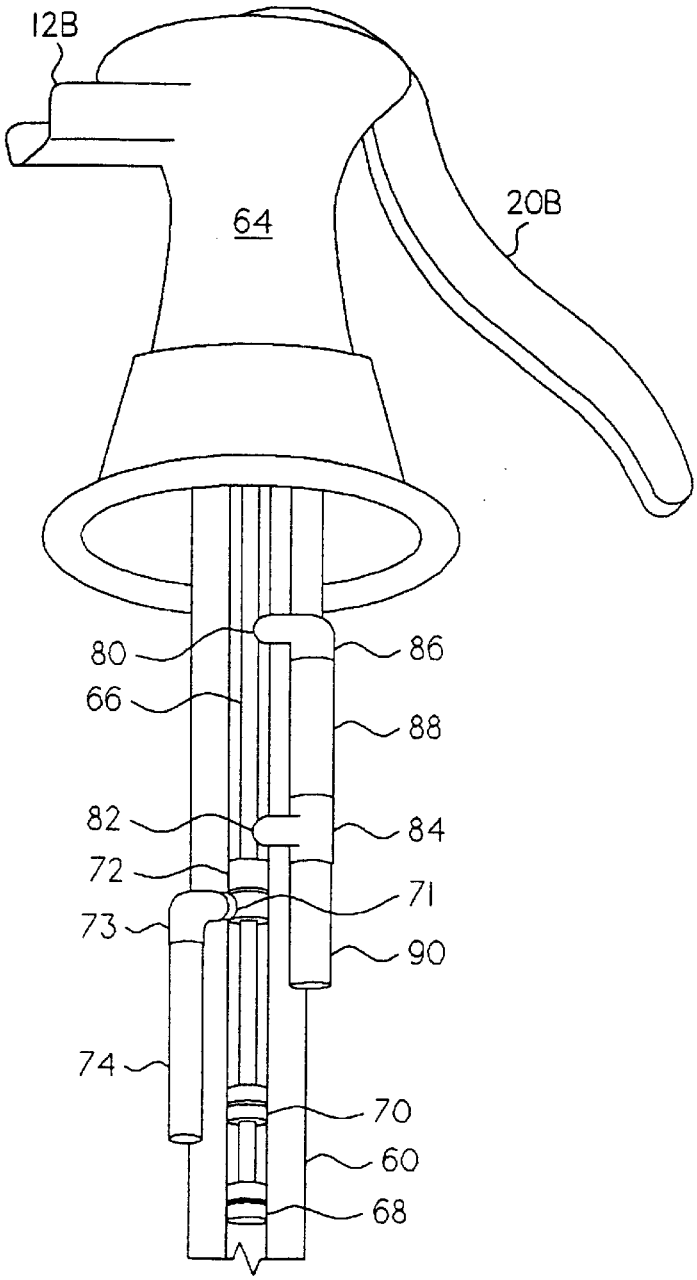
Figure 8:
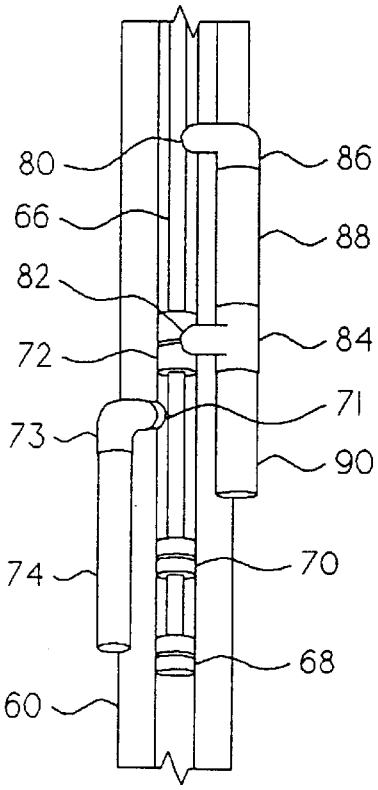
Figure 9:
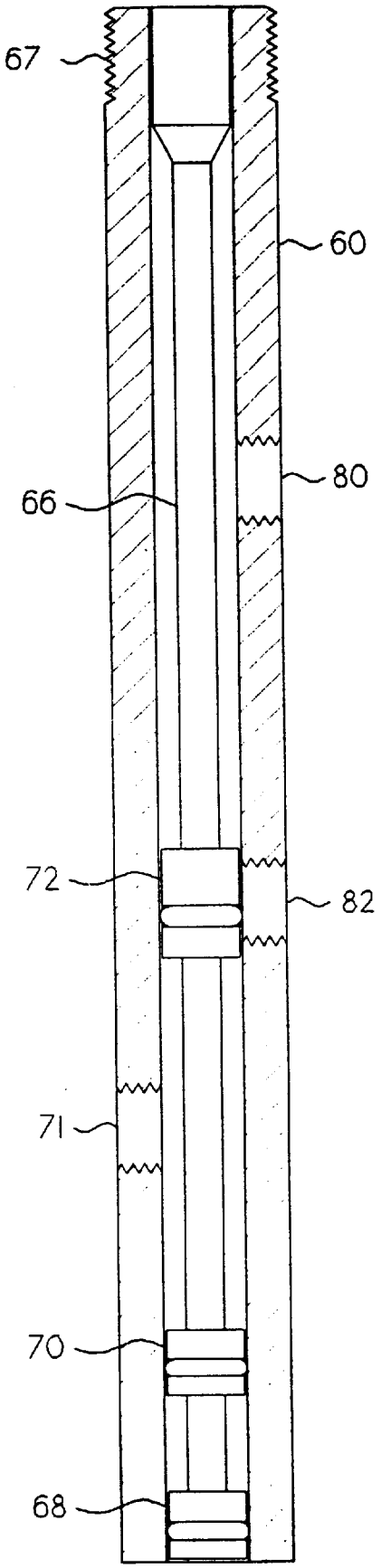
FIG. 9 is an enlarged, transverse sectional view of the housing and piston control for the second embodiment of pump system of the present invention.
Figure 10:
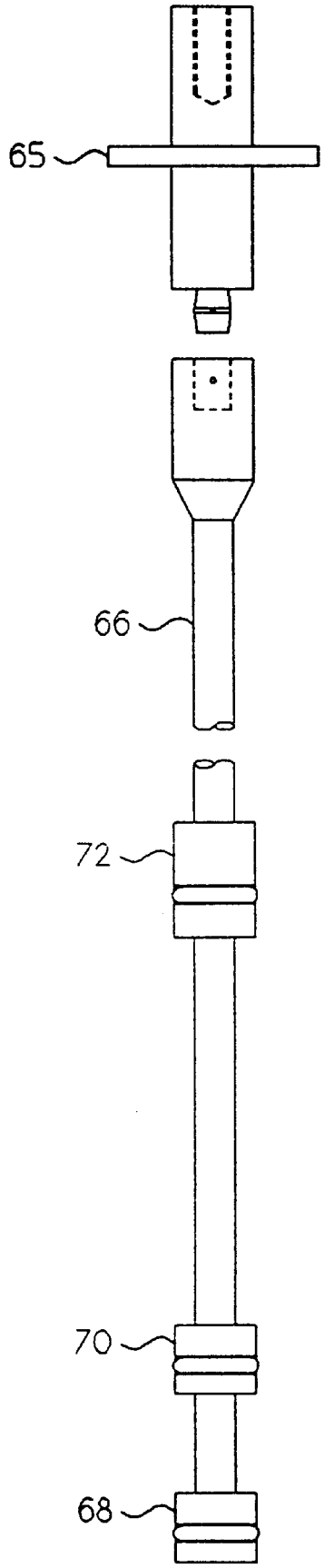
FIG. 10 is an exploded perspective view of the piston assembly.
Figure 11:
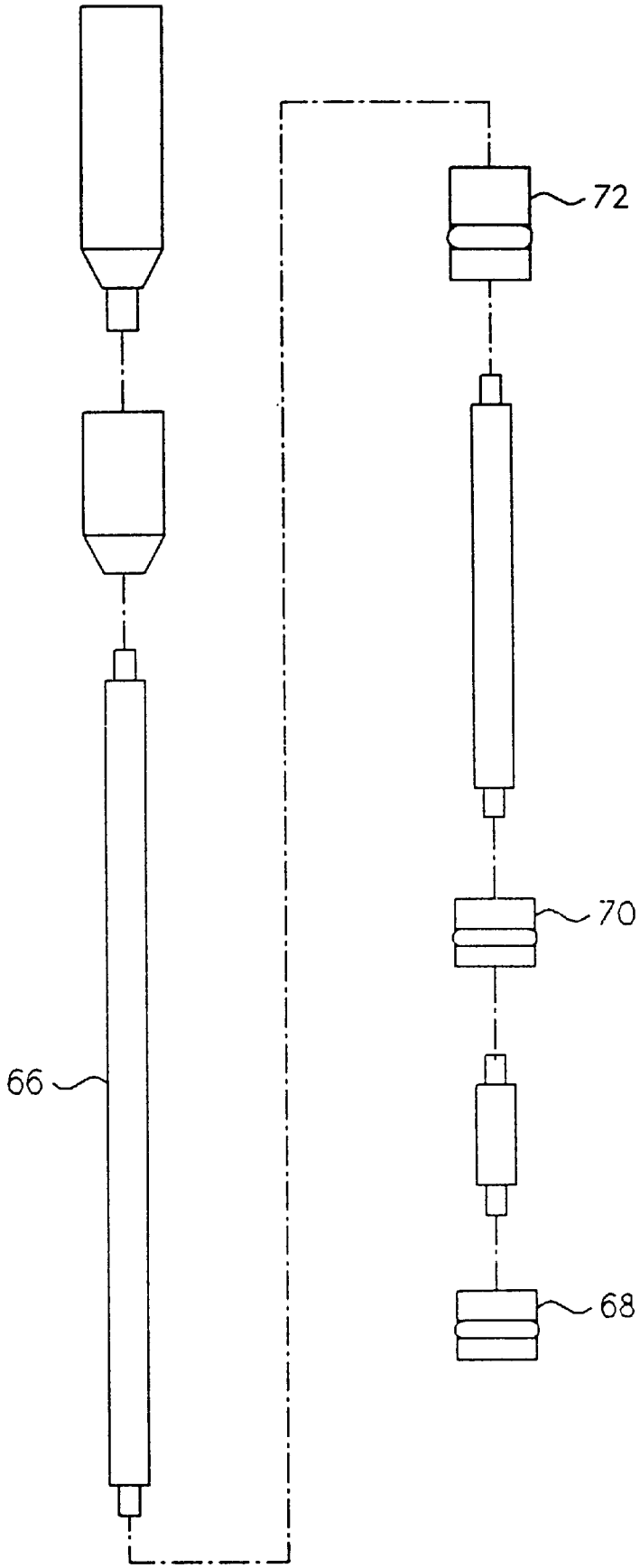
FIG. 11 is an exploded perspective view showing another form of the piston assembly for a pump system in accordance with the present invention.
Figure 12:
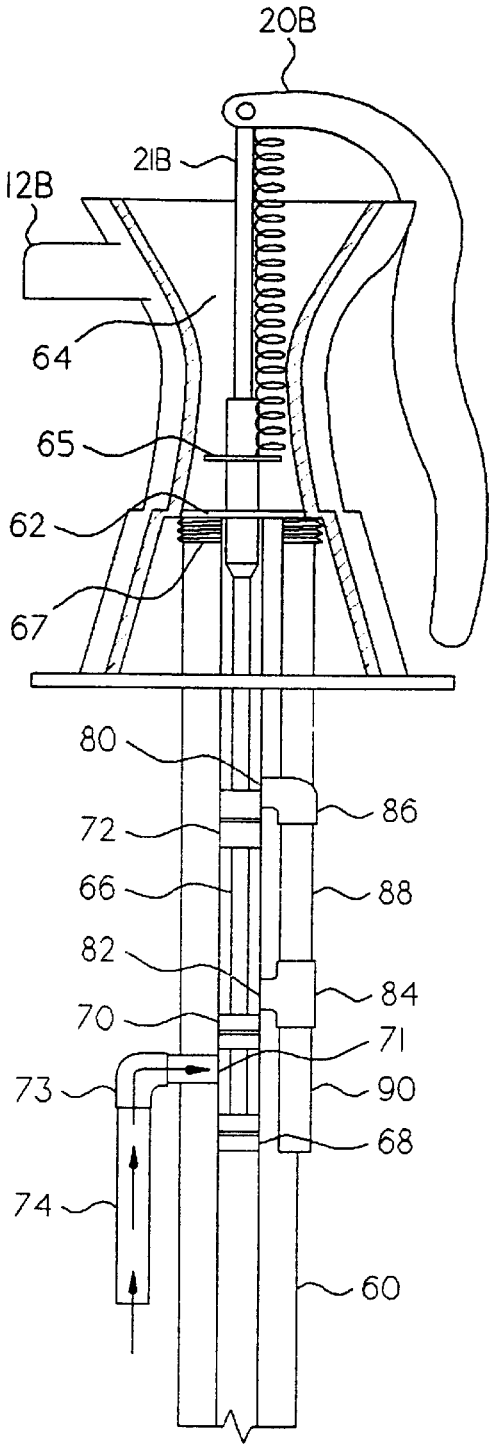
FIGS. 12 and 13 are side elevational views partly in section showing various operating positions of the pump system and fluid flow for the second embodiment of the present invention.
Figure 13:
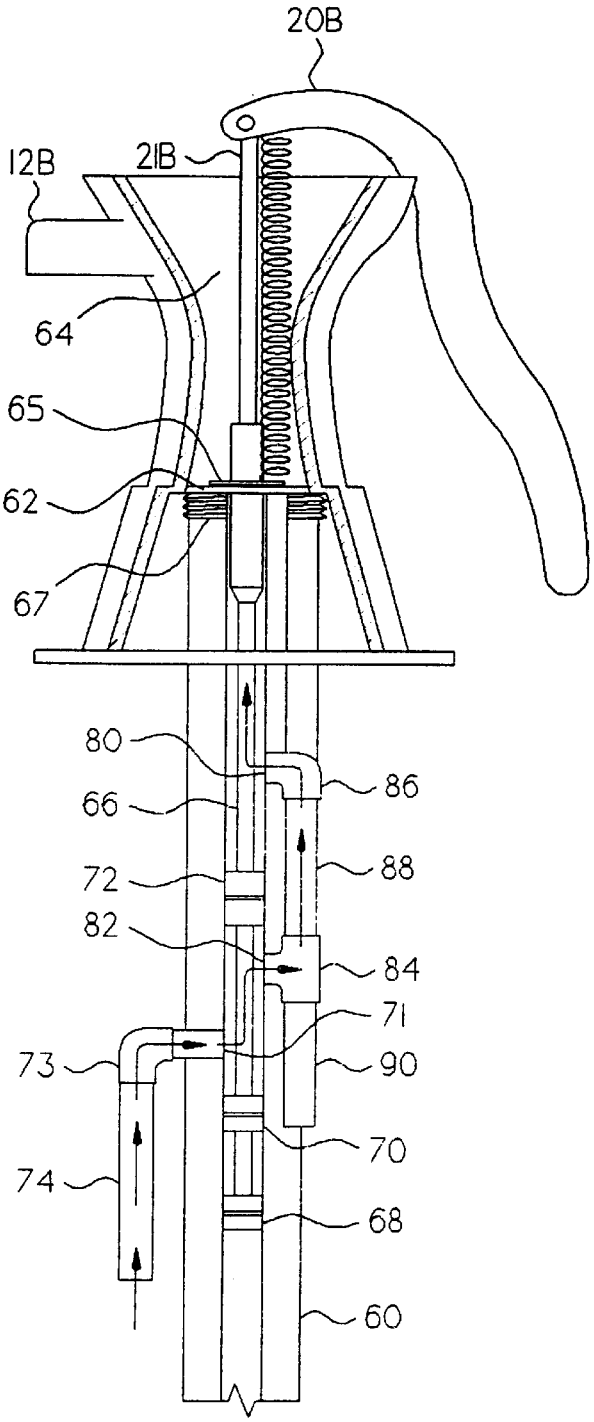

Considering now the operation of the system described above, the handle (20*b*) is normally in the lower position shown in FIG. 6. In this position, the water inlet port (71) communicates with the area between the control pistons (68, 70 and 72) and in this position water is prevented from flowing through pipe (88) and entering cylinder and water chamber (64). When the user desires to initiate flow through the spout (12*b*), the handle (20*b*) is raised to the position shown in FIG. 7, which moves the piston rod assembly to the position shown therein, wherein the inlet port (71) is aligned with the by-pass port (82) and water can flow to the water chamber (64) and out through the spout (12). When the handle is pivoted to the extreme up position (see FIG. 7A), flow to the water chamber (64) is again blocked so that when the handle is lowered from this position, water again flows as in FIG. 7.

Note that the rod (21*b*) connected to the piston rod is biased by a spring (S) to impart a pump-like feeling when the user activates the pump handle (20*b*) providing a resistive force as the handle (20*b*) is pulled upward and a restorative force as pump handle (20*b*) is pushed down. In this system as shown in FIG. 4, the water discharged from the spout (12) should include a collection system including a drain for disposing of the water discharged by the spout.

It is noted that the valve assembly may be located below ground and provides a frost-free system.

Even though particular embodiments of the present invention have been illustrated and described herein, it is not intended to limit the invention and changes and modifications may be made therein within the scope of the following claims.

What is claimed is:

1. A valving system for pumping water or other liquids and configured to simulate a fully functional, hand operated pump, comprising:

an elongated, generally cylindrical housing having an axial bore therein;

a spout assembly including a spout chamber and a discharge spout mounted at one end of the housing;

a piston rod engaging in said axial bore in the housing and connected to said handle;

a plurality of axially spaced pistons snugly engaging in said bore and located at predetermined spaced axial positions along said piston rod;

an inlet port in said housing connected to a suitable source of liquid under pressure;

axially spaced flow control ports connected by a line;

means for actuating said piston rod axially in said bore between a position wherein said inlet port is blocked by said pistons from delivering fluid under pressure to said flow control ports and a position wherein said pistons permit flow of pressurized fluid from said inlet port through said flow control ports and line to said spout chamber, thereby simulating fully functional hand manipulated pumps.

* * * * *